US007856855B2

(12) United States Patent
Fantl et al.

(10) Patent No.: US 7,856,855 B2
(45) Date of Patent: Dec. 28, 2010

(54) LOCK ASSEMBLY WITH REMOVABLE SHACKLE

(75) Inventors: Steven A. Fantl, Colgate, WI (US); Patrick Smith, Birmingham, MI (US)

(73) Assignee: Commando Lock Company, LLC, Troy, MI (US)

( * ) Notice: Subject to any disclaimer, the term of this patent is extended or adjusted under 35 U.S.C. 154(b) by 0 days.

(21) Appl. No.: 11/690,241

(22) Filed: Mar. 23, 2007

(65) Prior Publication Data

US 2007/0240459 A1 Oct. 18, 2007

Related U.S. Application Data

(60) Provisional application No. 60/785,333, filed on Mar. 23, 2006.

(51) Int. Cl.
*E05B 67/22* (2006.01)

(52) U.S. Cl. ..... 70/39; 70/38 A; 70/40

(58) Field of Classification Search ..... 70/38 A–38 C, 70/39, 40, 422

See application file for complete search history.

(56) References Cited

U.S. PATENT DOCUMENTS 3,143,872 A * 8/1964 Check ..... 70/38 A
4,183,566 A * 1/1980 Yates ..... 70/50
4,528,828 A * 7/1985 Poutiainen ..... 70/38 A
5,174,136 A * 12/1992 Thwing ..... 70/38 A
5,363,678 A 11/1994 Meckbach
5,377,511 A 1/1995 Meckbach
6,813,913 B2 11/2004 Watts
7,036,344 B2 * 5/2006 Gast et al. ..... 70/38 A
2002/0007654 A1 * 1/2002 Watts ..... 70/38 A

FOREIGN PATENT DOCUMENTS

AU A51912/93 10/1994
AU A53587/93 1/1995

* cited by examiner

*Primary Examiner*—Suzanne Dino Barrett
*Assistant Examiner*—Christopher Boswell
(74) *Attorney, Agent, or Firm*—Carlson, Gaskey & Olds PC

(57) ABSTRACT

A lock assembly has a lock body and a shackle. The shackle has a leg. A locking element is disposed in the lock body. The locking element is selectively engageable to the shackle. A cam is disposed in the lock body. The cam has a lock position for moving the locking element to engage the shackle. There is also an unlocked position for moving the locking element to disengage the shackle. The cam has a shackle removal position for removing the shackle from the lock body. The leg has a shackle removal recess sized to receive the locking element sufficiently so as to permit movement of the cam to the shackle removal position. The cam is configured to displace the locking element into the shackle removal recess.

12 Claims, 6 Drawing Sheets

LOCK ASSEMBLY WITH REMOVABLE SHACKLE

CROSS-REFERENCE TO RELATED APPLICATIONS

This application claims priority to U.S. Provisional Patent Application 60/785,333 filed on Mar. 23, 2006.

BACKGROUND OF THE INVENTION

A padlock typically has a shackle that engages a lock body. The shackle can be opened and then locked to secure a large variety of different objects, such as doors, gates, bicycles, and fences. Given this variety, different shackle sizes may be required to lock any particular object. Generally, a consumer must purchase a different padlock for each shackle size. Consequently, one padlock for one application may be ill-suited for another, requiring an individual to keep an inventory of different padlocks on hand as well as their associated keys.

It is known to provide lock assemblies with removable shackles. One known design achieves this function through a specially designed cam located within the lock body. The cam has one position for locking the shackle to the lock body. A key may be turned to move the cam to unlock the shackle. Further turning of the cam allows the shackle to be removed. The cam has a deep recess so that the shackle may clear the lock body. However, having this deep recess in the cam may weaken the structural integrity of the lock.

Therefore, a need exists for a lock with a removable shackle that has a design that does not impair the security of the lock.

SUMMARY OF THE INVENTION

The present invention comprises a lock body with a shackle. The shackle has a leg. A locking element is disposed in the lock body. The locking element is selectively engageable to the shackle. An actuator, such as a cam, is disposed in the lock body. The actuator has a lock position for moving the locking element to engage the shackle. In addition, the actuator has an unlocked position for moving the locking element to disengage the shackle. The actuator also has a shackle removal position for selectively removing the shackle from the lock body. In contrast to existing lock assemblies, the inventive lock has a shackle removal recess configured to receive the locking element so that shackle may be removed from the lock body. By placing this recess on the shackle, the integrity of the lock is not impaired.

The shackle removal recess is sized to receive the locking element sufficiently to permit movement of the actuator to the shackle removal position. In addition, the actuator is configured to displace the locking element into the shackle removal recess. The shackle may have a first position permitting the locking element to engage the shackle when the actuator is in the locked position and a second position permitting access to the shackle removal recess. The shackle may be rotatable from the first position to the second position.

In addition, the invention includes a unique method of distributing the lock assembly. The lock body is provided with two different shackles in a single package. One shackle may be larger than the other. Alternatively, one shackle may have a cable for locking a bicycle or a standard shackle for locking a door. In this way, a consumer need only have one single lock with one single key to address a larger number of different lock applications.

The various features and advantages of this invention will become apparent to those skilled in the art from the following detailed description. The drawings that accompany the detailed description can be briefly described as follows.

DETAILED DESCRIPTION OF THE PREFERRED EMBODIMENT

Figure 1:
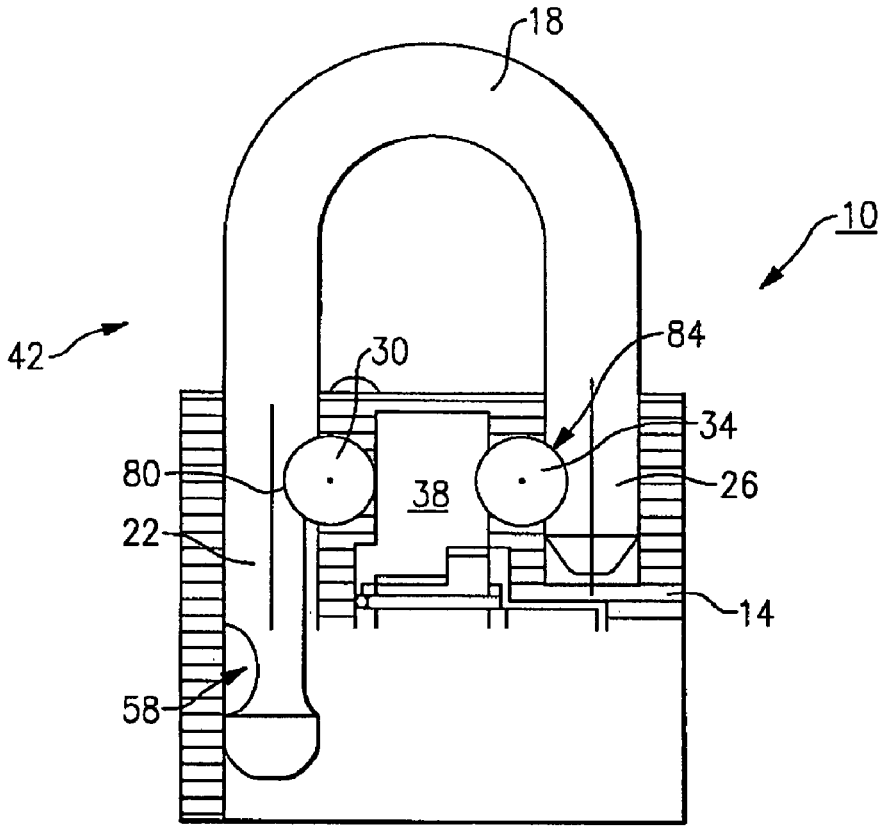
FIG. 1 illustrates a side cross-sectional view of the inventive lock assembly in the locked position, showing shackle, lock body, actuator and locking elements.

FIG. 1 illustrates a side cross-sectional view of inventive lock assembly 10. Lock assembly 10 has lock body 14 in which is disposed shackle 18. Shackle 18 has first leg 22 and second leg 26. Further disposed within lock body 14 is first locking element 30 and second locking element 34, here ball bearings. First locking element 30 and second locking element 34 are shown in contact with actuator 38, here a cam, which is shown in locked position 42.

Figure 2:
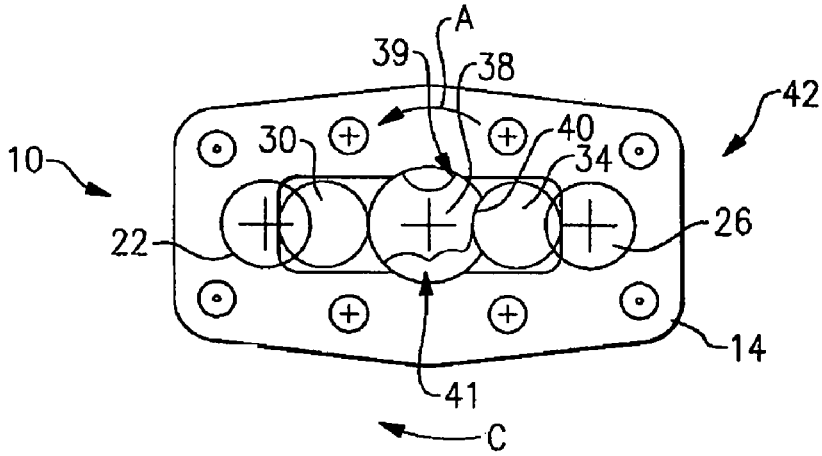
FIG. 2 illustrates an overhead cross-sectional view of the lock assembly of FIG. 1, showing actuator in the locked position.

As shown in FIG. 2, actuator 38 has three recesses: first recess 39, second recess 40 and third recess 41. As shown, second recess 40 is the shallowest while third recess 41 is the deepest. First recess 39 is between second recess 40 and third recess 41 in depth. Each recess is a scallop of actuator 38, which is rotatable within lock body 14 so that different recesses may be presented to first locking element 30 and second locking element 34 as will be explained.

FIGS. 1 and 2 show lock assembly 10 in a locked condition. Here actuator 38, as shown in FIG. 2, displaces first locking element 30 and second locking element 34 into lock recess 80 and lock recess 84 of shackle 18 as known. In this locked condition, shackle 18 is locked to lock body 14 through the engagement of first locking element 30 and second locking element 34.

Figure 3:
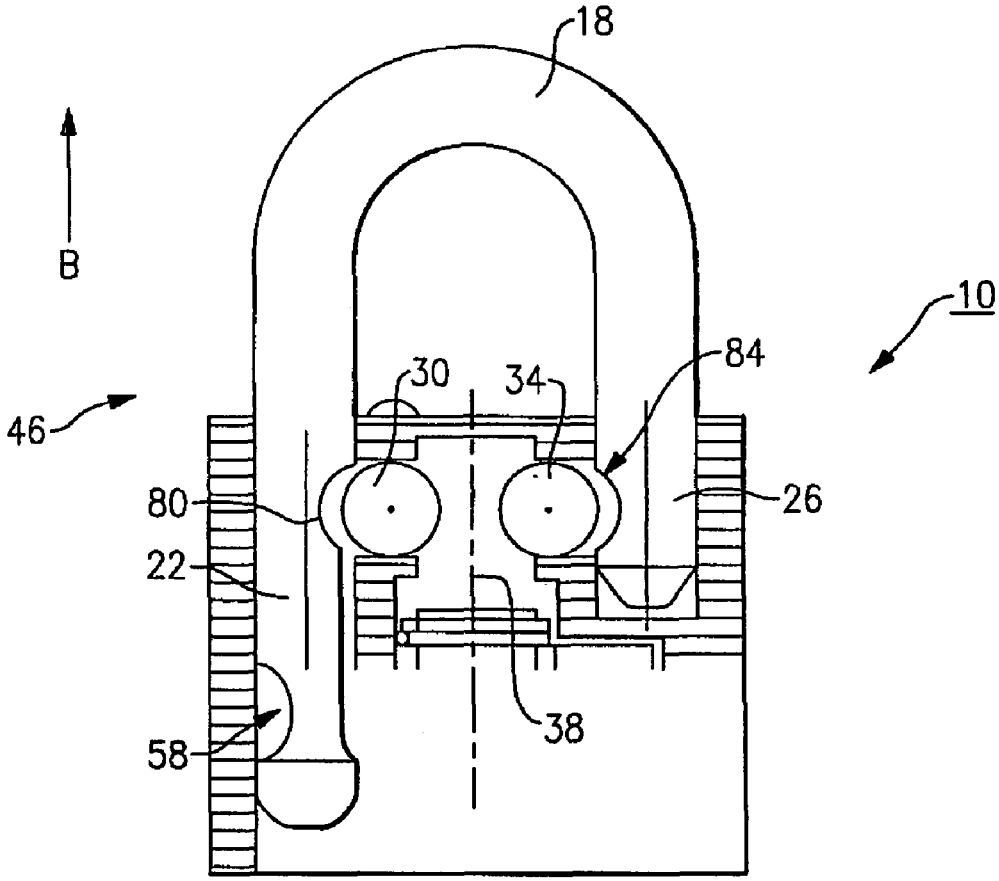
FIG. 3 illustrates a side cross-sectional view of the lock assembly of FIGS. 1 and 2 in the unlocked position.
Figure 4:
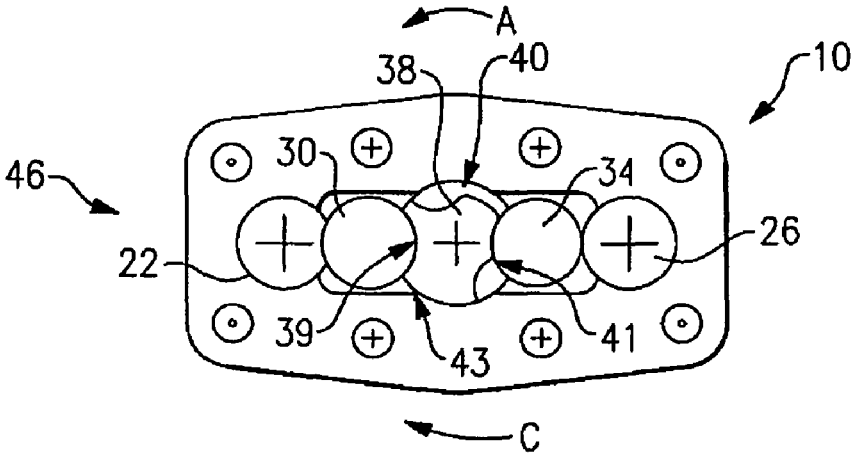
FIG. 4 illustrates an overhead cross-sectional view of the lock assembly of FIG. 3 with actuator in the unlocked position.
Figure 5:
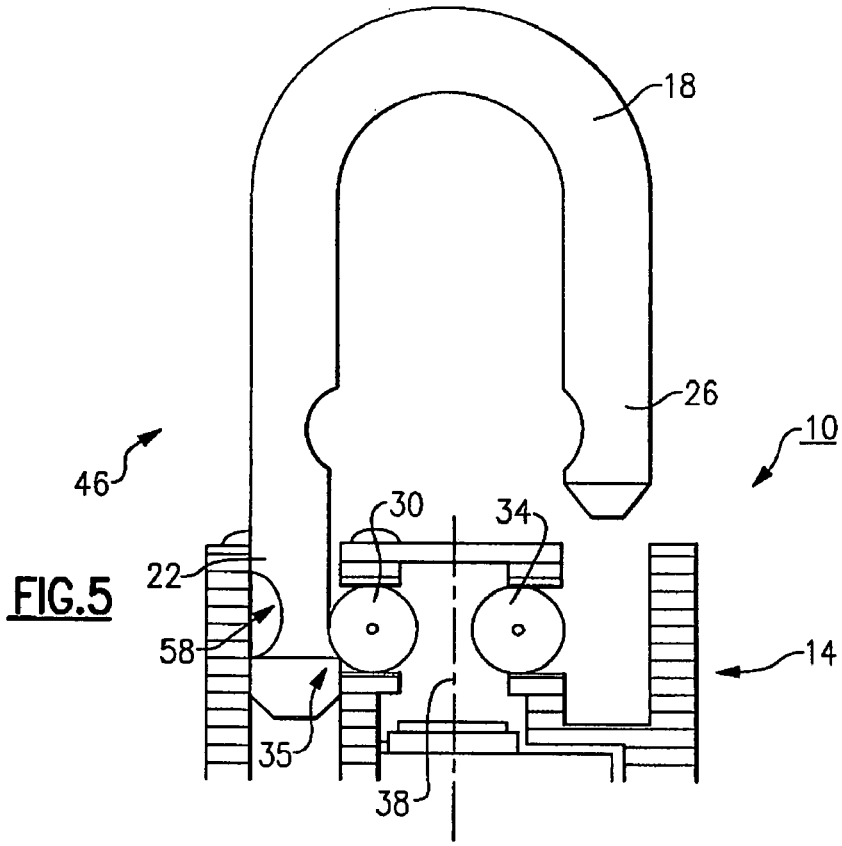
FIG. 5 illustrates a side cross-sectional view of the lock assembly of FIG. 3 with shackle lifted from the lock body.

To unlock lock assembly 10, actuator 38 is turned, such as by key, from locked position 42 shown in FIG. 2 to unlocked position 46 shown in FIG. 4 by turning actuator 38 in the direction of arrow A. When actuator 38 is in unlocked position 46, first locking element 30 and second locking element 34 disengage shackle 18 as shown in FIG. 3 because first locking element 30 and second locking element 34 are received in first recess 39 and third recess 41 thereby bringing locking elements 30, 34 away from lock recesses 80, 84. Here, shackle 18 may be moved in the direction of arrow B to the position shown in FIG. 5. Shackle 18 has skirt 35 that prevents shackle 18 from being lifted completely out of lock body 14. From this position, lock assembly 10 is now open to secure objects as known.

Figure 6:
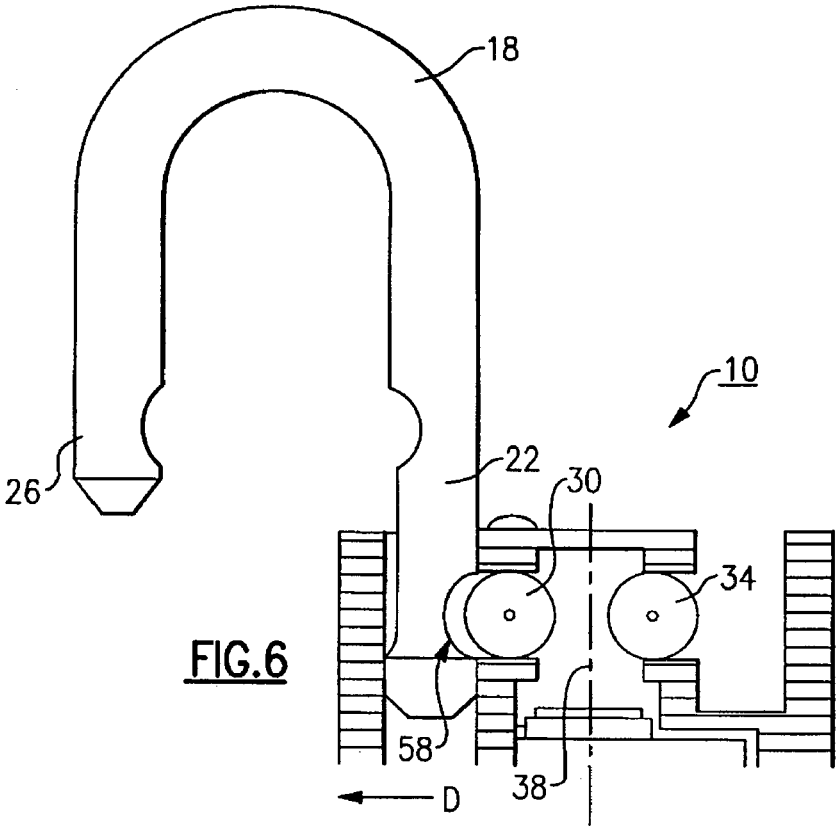
FIG. 6 illustrates the lock assembly of FIG. 5 with shackle turned to expose shackle removal recess to a locking element.
Figure 7:
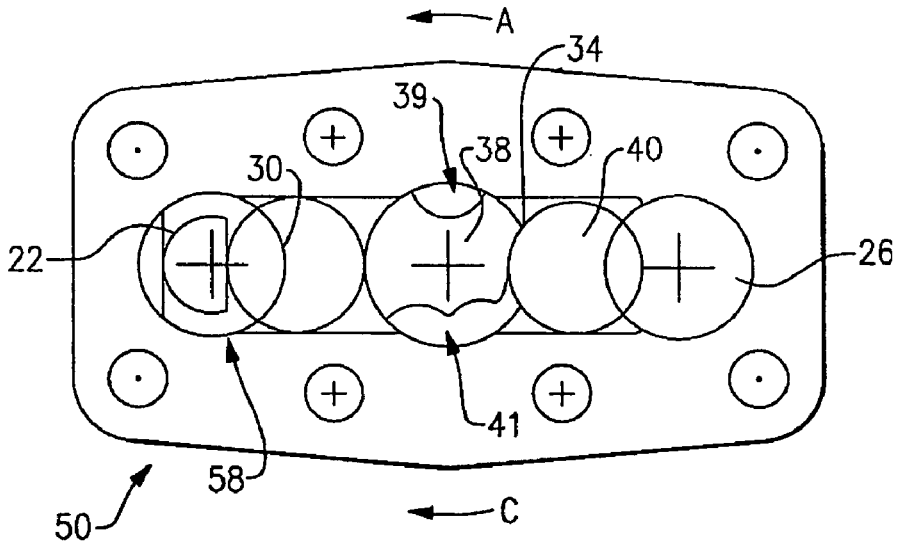
FIG. 7 illustrates an overhead view of the lock assembly of FIG. 6 with locking element displaced into shackle removal recess.
Figure 8:
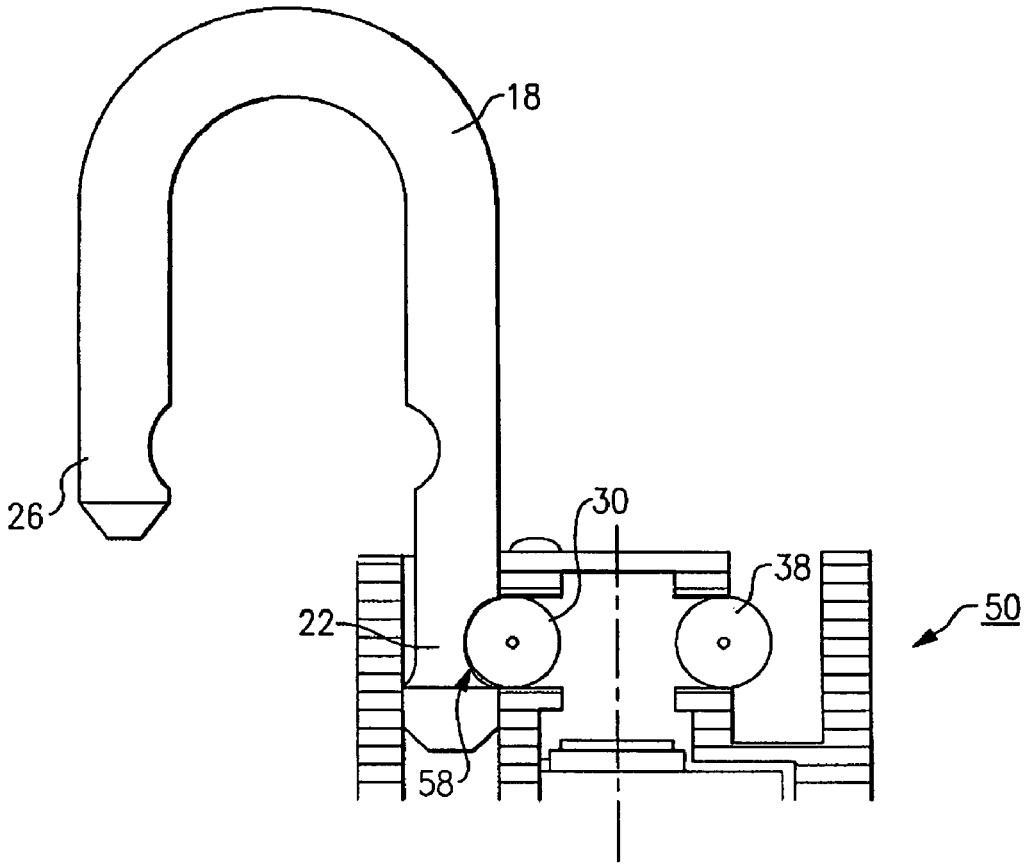
FIG. 8 illustrates a side cross-sectional view of the lock assembly of FIG. 7, with locking element displaced into shackle removal recess.
Figure 9:
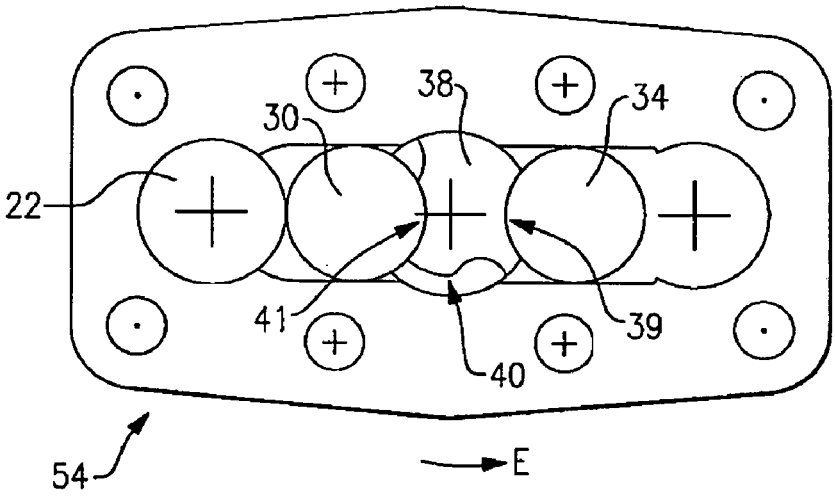
FIG. 9 illustrates an overhead cross-sectional view of the inventive lock assembly with cam in the shackle removal position.
Figure 10:
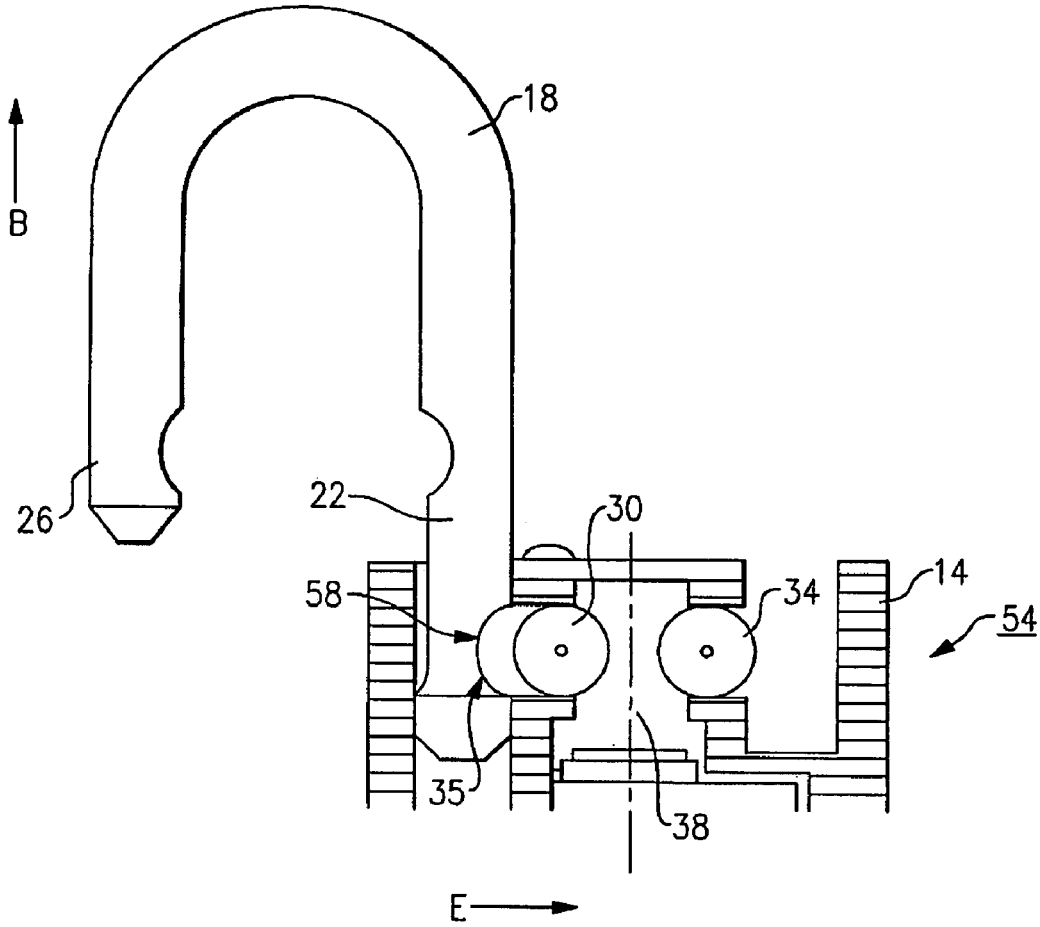
FIG. 10 illustrates lock assembly of FIG. 9 with shackle now released for removal from the lock body.

It may be desirable to replace shackle 18 with another shackle. To remove shackle 18 from locked body 14, shackle 18 is rotated so as to expose shackle removal recess 58 to first locking element 30 as shown in FIG. 6. Shackle 18 may be turned in the direction of arrow A or in the opposite direction of arrow C as shown in FIG. 2. Prior to turning of shackle 18 to expose shackle removal recess 58, shown in FIG. 4, the position of locking element 30 prevents actuator 38 from turning in the direction of either arrow A or arrow C. With shackle 18 now exposing shackle removal recess 58 to locking element 30, locking element 30 has space to move in the direction of arrow D into shackle removal recess 58, which is sized to receive part of locking element 30 as seen in FIG. 7 and 8. With reference to these figures, locking element 30 may be displaced into shackle removal recess 58 by rotating actuator 38 to locking element displacement position 50 in the direction of arrow C. As shown in FIG. 7, locking element 30 has moved into shackle removal recess 58 because of the action of edge 43 of actuator 38 rotating in the direction of arrow C. As shown in FIG. 7, shackle removal recess 58 is deep enough to receive enough of first locking element 30 so that actuator 38 may turn in the direction of arrow C to locking element displacement position 50. From there, actuator 38 may be turned further in the direction of arrow C to shackle removal position 54, as shown in FIG. 9, exposing third recess 41, the deepest recess, to first locking element 30. Locking element 30 moves in the direction of arrow E into third recess 41, thereby moving completely out of the path of skirt 35 as shown in FIG. 10 to permit shackle 18 to be removed in the direction of arrow B completely from lock body 14. In this way, lock assembly 10 allows for the removal of shackle 18 without weakening its structural integrity.

Figure 11:
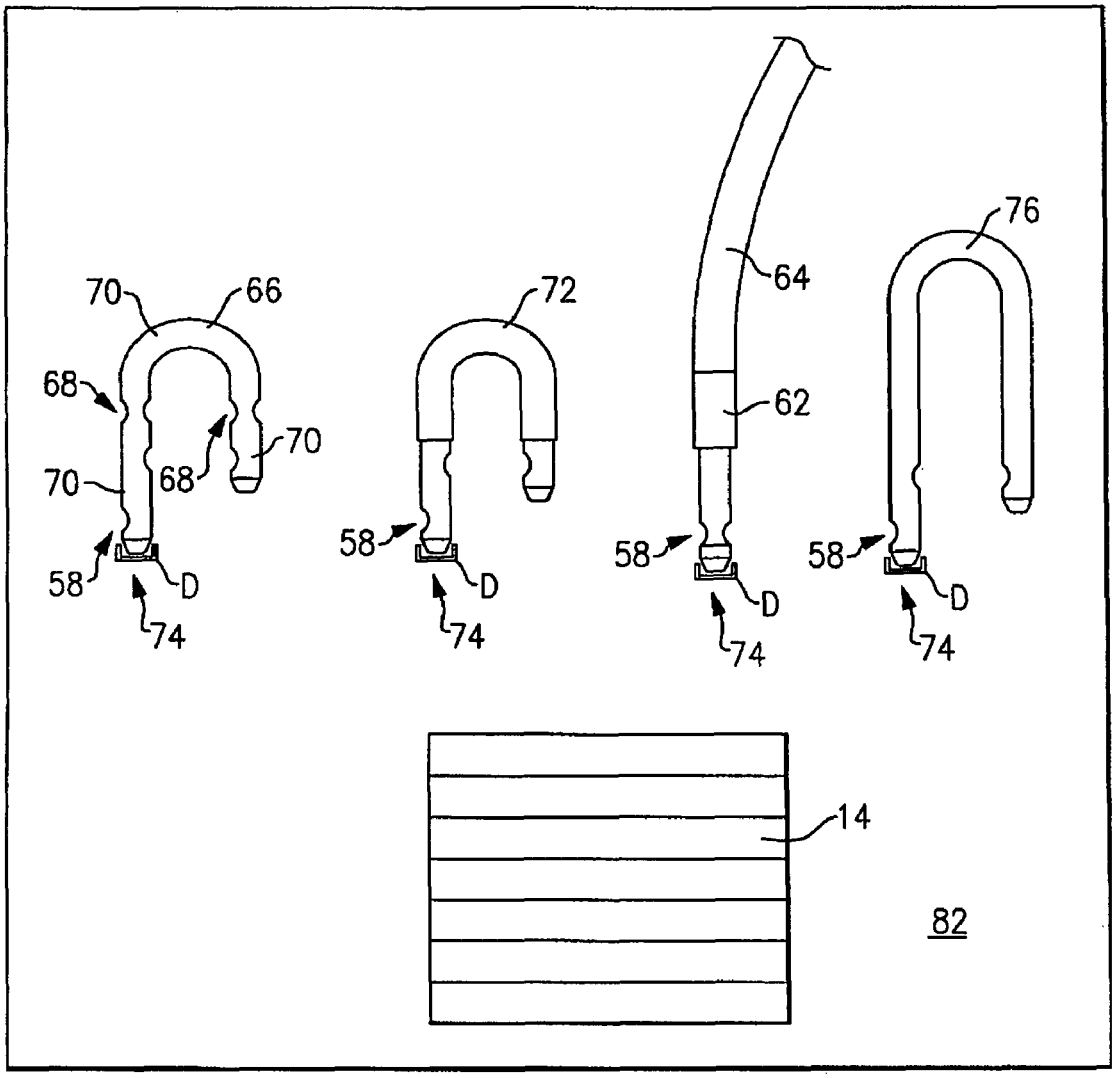
FIG. 11 illustrates an inventive distribution technique.

As shown in FIG. 11, to provide convenience to users of lock assembly 10, lock body 14 may be packaged in package 82 with a variety of shackles as shown. For example, shackle 62 with cable 64 may be part of package 82 along with shackle 66, shackle 72 and shackle 76. Shackle 62 has cable 64 in contrast to the other shackles. Shackle 72 is shorter than shackle 76 as shown. Shackle 70 has weakened area 68 to permit shackle 66 to be broken with sufficient force if necessary to unlock the lock without a key. Further, shackle 72 may be made from a different material or with a different hardness then shackle 74. One material may be a standard hardened steel while the other a specialty alloy. Remainder 70 of shackle is unweakened. Shackles 62, 66, 72 and 76 are all provided shackle removal recess 58 and with engagement feature 74 having predetermined size D, which is sized to be received in lock body 14 in the manner shown in FIGS. 1-10. In this way, a single lock body may be used with multiple shackles of differing sizes and differing functions.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

We claim:

1. A lock assembly comprising:

a lock body;

a shackle having a first leg;

a first locking element disposed in said lock body, said first locking element selectively engageable to said shackle;

a cam disposed in said lock body, said cam having a locked position for moving said first locking element to engage said shackle, an unlocked position for moving said first locking element to a first recess of said cam to disengage said shackle, a locking element displacement position to displace said first locking element into a shackle removal recess of said first leg, and a shackle removal position for moving said first locking element into a second, deeper recess of said cam for selectively removing said shackle from said lock body; and wherein said cam includes a third recess and a fourth recess, and said first recess, said second, deeper recess, said third recess and said fourth recess are each circumferentially disposed about an outer peripheral surface of said cam, and said first recess, said second, deeper recess, said third recess and said fourth recess are each selectively engageable to at least one of said first locking element and a second locking element disposed in said lock body.

2. The lock assembly of claim 1 wherein said shackle removal recess is sized to receive said first locking element sufficiently so as to permit movement of said cam to said shackle removal position.

3. The lock assembly of claim 1 wherein said cam is configured to displace said first locking element into said shackle removal recess.

4. The lock assembly of claim 1 wherein said shackle has a first position permitting said locking element to engage said shackle when said cam is in said locked position and a second position permitting access to said shackle removal recess.

5. The lock assembly of claim 4 wherein said shackle is rotatable, said first position rotatably displaced from said second position.

6. The lock assembly of claim 1 wherein said cam is rotatable into said locked position, said unlocked position, and said shackle removal position.

7. The lock assembly of claim 1 wherein said cam is configured so that from said locked position, said cam must move to said unlocked position, then to said locking element displacement position prior to movement to said shackle removal position.

8. The lock assembly of claim 1 wherein said shackle includes a second leg and a second locking element, said second locking element engageable to said second leg when said cam is in said locked position and disengaged from said second leg when said cam is in said unlocked position.

9. The lock assembly of claim 1 wherein said shackle includes a cable.

10. The lock assembly of claim 1 wherein said shackle has a weakened area to permit said shackle to be broken in said weakened area more easily than a remainder of said shackle.

11. The lock assembly as recited in claim 1, wherein said third recess and said fourth recess are circumferentially disposed about said outer peripheral surface between said first recess and said second, deeper recess.

12. The lock assembly as recited in claim 1, wherein said third recess is positioned directly adjacent to said second, deeper recess and said fourth recess is positioned directly adjacent said third recess, and said second, deeper recess transitions directly into said third recess and said third recess transitions directly into said fourth recess.

* * * * *